US009599298B2

(12) United States Patent
Farmer

(10) Patent No.: US 9,599,298 B2
(45) Date of Patent: Mar. 21, 2017

(54) RETROFITTABLE LED MODULE WITH HEAT SPREADER

(71) Applicant: BRIDGELUX, INC., Livermore, CA (US)

(72) Inventor: Todd Farmer, Livermore, CA (US)

(73) Assignee: BRIDGELUX INC., Livermore, CA (US)

( * ) Notice: Subject to any disclaimer, the term of this patent is extended or adjusted under 35 U.S.C. 154(b) by 0 days.

(21) Appl. No.: 14/691,505

(22) Filed: Apr. 20, 2015

(65) Prior Publication Data

US 2015/0226393 A1 Aug. 13, 2015

Related U.S. Application Data

(62) Division of application No. 13/228,220, filed on Sep. 8, 2011, now Pat. No. 9,033,558.
(Continued)

(51) Int. Cl.

| | |
|---|---|
| ***F21S 8/08*** | (2006.01) |
| ***F21V 29/70*** | (2015.01) |
| ***F21V 19/00*** | (2006.01) |
| ***F21V 29/71*** | (2015.01) |
| ***F21V 29/89*** | (2015.01) |
| *F21V 21/24* | (2006.01) |
| *F21W 131/103* | (2006.01) |
| *F21Y 101/00* | (2016.01) |

(52) U.S. Cl.
CPC ..... *F21S 8/088* (2013.01); *F21K 9/20* (2016.08); *F21S 8/086* (2013.01); *F21V 19/0055* (2013.01); *F21V 29/70* (2015.01); *F21V 29/713* (2015.01); *F21V 29/89* (2015.01); *F21V 21/24* (2013.01); *F21W 2131/103* (2013.01); *F21Y 2101/00* (2013.01); *F21Y 2105/10* (2016.08); *F21Y 2115/10* (2016.08); *Y10T 29/49716* (2015.01)

(58) Field of Classification Search
CPC .... F21K 9/10; F21K 9/30; F21S 8/086; F21S 8/088; F21V 19/0055; F21V 29/70; F21V 29/713; F21V 29/89
See application file for complete search history.

(56) References Cited

U.S. PATENT DOCUMENTS

| | | | |
|---|---|---|---|
| 2007/0132359 | A1 | 6/2007 | Wang et al. |
| 2008/0068799 | A1 | 3/2008 | Chan |

(Continued)

FOREIGN PATENT DOCUMENTS

| | | |
|---|---|---|
| CN | 201074751 | 6/2008 |
| TW | 200913221 | 3/2009 |

OTHER PUBLICATIONS

International Search Report and Written Opinion dated Mar. 23, 2012 regarding PCT Patent Application No. PCTUS2011060074.
(Continued)

*Primary Examiner* — Anh Mai
*Assistant Examiner* — Nathaniel Lee
(74) *Attorney, Agent, or Firm* — Arent Fox LLP

(57) ABSTRACT

A light source includes one or more solid state light emitting devices, a heat spreader thermally coupled to the one or more light emitting devices, and a mounting carriage configured to mount the one or more solid state light emitting devices in a lighting fixture light and thermally couple the heat spreader to the lighting fixture.

8 Claims, 4 Drawing Sheets

Related U.S. Application Data

(60) Provisional application No. 61/412,751, filed on Nov. 11, 2010.

(56) References Cited

U.S. PATENT DOCUMENTS

| | | | | |
|---|---|---|---|---|
| 2009/0147522 | A1 | 6/2009 | Shuai et al. | |
| 2009/0168416 | A1 | 7/2009 | Zhang et al. | |
| 2009/0257224 | A1 | 10/2009 | Huang et al. | |
| 2009/0323340 | A1 | 12/2009 | Yang et al. | |
| 2010/0053964 | A1 | 3/2010 | Yang et al. | |
| 2010/0060157 | A1 | 3/2010 | Shi | |
| 2010/0283605 | A1 | 11/2010 | Nevins | |
| 2011/0068708 | A1* | 3/2011 | Coplin | F21K 9/00 315/294 |
| 2011/0222284 | A1 | 9/2011 | Kong et al. | |

OTHER PUBLICATIONS

Taiwan Office Action dated May 26, 2014 regarding Taiwanese Patent Application No. 100141189.

Decision of Rejection dated Nov. 27, 2014 regarding Taiwanese Patent Application No. 100141189.

* cited by examiner

RETROFITTABLE LED MODULE WITH HEAT SPREADER

CROSS-REFERENCE TO RELATED APPLICATION(S)

This application is a divisional of U.S. patent application Ser. No. 13/228,220 titled "RETROFITTABLE LED MODULE WITH HEAT SPREADER", filed Sep. 8, 2011, allowed, which in turn claims the benefit of No. 61/412,751, entitled "RETROFITTABLE LED MODULE WITH HEAT SPREADER", filed on Nov. 11, 2010, the contents of which are expressly incorporated by reference herein in their entirety.

BACKGROUND

Field

The present disclosure relates to illumination devices. More particularly, the disclosure relates to solid state light emitting devices mounted on a heat spreader in existing light fixtures.

Background

Solid state light emitting devices, such as light emitting diodes (LEDs), are attractive candidates for replacing conventional light sources such as incandescent, halogen and fluorescent lamps. LEDs have substantially higher light conversion efficiencies than incandescent and halogen lamps and longer lifetimes than all three of these types of conventional light sources. In addition, some types of LEDs now have higher conversion efficiencies than fluorescent light sources and still higher conversion efficiencies have been demonstrated in the laboratory. Finally, LEDs contain no mercury or other potentially dangerous materials, therefore, providing various safety and environmental benefits.

More recently, solid state devices have been used to replace high-intensity discharge (HID) lamps to provide high levels of light over large areas when energy efficiency and/or light intensity are required. These areas include roadways, parking lots, pathways, large public areas, and other outdoor applications. To increase the intensity of light in these applications, often more than one solid state light emitting device is arranged in a package. An example of a solid state light emitting device is a light emitting semiconductor chip comprising a p-n junction. An example of a package is a collection of light emitting devices arranged on a substrate and encapsulated in a phosphor to produce broad spectrum white light. This package is sometimes referred to as an "LED array." A heat sink is often attached to the LED array to dissipate heat generated by the light emitting devices.

LEDs are being used to replace high intensity discharge (HID) lamps in legacy street lights. The conversion to LED-based street lights generally involves replacing the existing head portion attached to the top of the pole with a new LED-based head. Although it would be more cost effective to simply retrofit the head portion with an LED module, it is currently very difficult because the head portion needs to be modified to provide a thermal connection to the LED module to dissipate the heat generated by the LEDs.

SUMMARY

LEDs are being used to replace high intensity discharge (HID) lamps in legacy street lights. The conversion to LED-based street lights generally involves replacing the existing head portion attached to the top of the pole with a new LED-based head. Although it would be more cost effective to simply retrofit the head portion with an LED module, it is currently very difficult because the head portion needs to be modified to provide a thermal connection to the LED module to dissipate the heat generated by the LEDs.

A modular LED array is disclosed for retrofitting into head portions of existing street lights to address the drawbacks associated with heat dissipation in LED street lights. An LED array may be mounted onto a heat spreader. The heat spreader may be aluminum or some other suitable material. A mounting carriage may be used to support the LED array and heat spreader. The mounting carriage may be arranged for mounting to the top of the head using the existing screw holes for the reflector. The mounting carriage may be attached using spring bolts or some other suitable mechanism that forces the heat spreader into direct contact with the head for thermal conductivity. A thermal interface material may be used between the heat spreader and head to provide a better thermal connection. The thermal interface material may be thermal grease, thermal epoxy, or some other suitable material.

In an embodiment, a light source includes one or more solid state light emitting devices, a heat spreader thermally coupled to the one or more light emitting devices, and a mounting carriage configured to mount the one or more solid state light emitting devices in a head of a street light and thermally couple the heat spreader to the light fixture.

In an embodiment of a modular LED array, the mounting carriage may be adjustable so that it can mount into any light fixture portion.

In an embodiment, a light source includes one or more solid state light emitting devices, a heat spreader, and a mounting carriage configured to support the one or more solid state light emitting devices in thermal contact with heat spreader. The mounting carriage is further configured to attach to a head of a street light to provide thermal coupling between the one or more solid state light emitting devices and the lighting fixture.

In an embodiment, a light source includes one or more solid state light emitting devices, a heat spreader attached to the one or more light emitting devices, and a mounting carriage configured to support the one or more solid state light emitting devices and the heat spreader. The mounting carriage is further configured to be attached to a head of a street light with the heat spreader being biased into contact with the lighting fixture.

In an aspect of the disclosure, a street light includes a pole, and an arm and a head attached to the pole. The head includes one or more solid state light emitting devices, a heat spreader thermally coupled to the one or more solid state light emitting devices, and a mounting carriage mounting the one or more solid state light emitting devices in the lighting fixture and thermally coupling the heat spreader to the lighting fixture.

DETAILED DESCRIPTION

Figure 1:
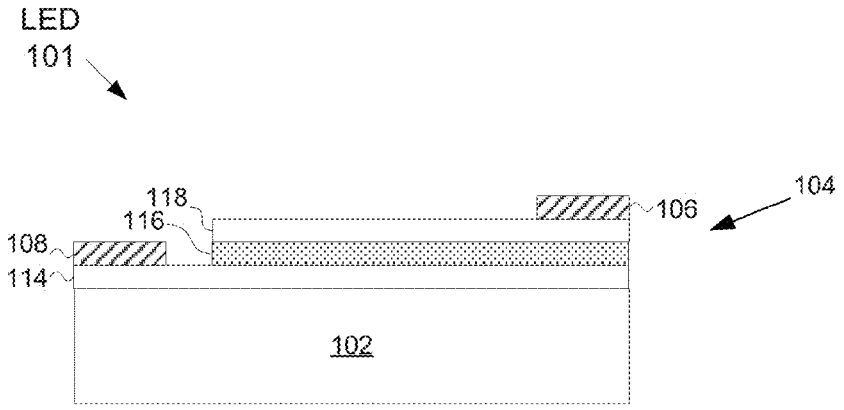
FIG. 1 is a conceptual cross-sectional side view illustrating an example of an LED.

The present invention is described more fully hereinafter with reference to the accompanying drawings, in which various aspects of the present invention are shown. For purposes of this disclosure, "street light" refers to any lighting system that provides any illumination to a street, road, walkway, tunnel, park, outdoor facility, parking lot, or the like. A "pole" refers any structure for supporting a lighting system, including, for example, a lamp post, hi-bay support, wall mounting, suspended hanging fixture, support frame, ceiling mount, or the like. A "Head" refers to the entity providing mechanical and environmental enclosure to the light source. An "Arm" refers to the horizontal vertical extension from the pole to the head. A "thermal management system" may comprise at least one of a heat sink, heat spreader, heat fin, heat pipe, thermal interface material, active air movement devices, or the like. This invention, however, may be embodied in many different forms and should not be construed as limited to the various aspects of the present invention presented throughout this disclosure. Rather, these aspects are provided so that this disclosure will be thorough and complete, and will fully convey the scope of the present invention to those skilled in the art. The various aspects of the present invention illustrated in the drawings may not be drawn to scale. Rather, the dimensions of the various features may be expanded or reduced for clarity. In addition, some of the drawings may be simplified for clarity. Thus, the drawings may not depict all of the components of a given apparatus (e.g., device) or method.

Various aspects of the present invention will be described herein with reference to drawings that are schematic illustrations of idealized configurations of the present invention. As such, variations from the shapes of the illustrations as a result, for example, manufacturing techniques and/or tolerances, are to be expected. Thus, the various aspects of the present invention presented throughout this disclosure should not be construed as limited to the particular shapes of elements (e.g., regions, layers, sections, substrates, etc.) illustrated and described herein but are to include deviations in shapes that result, for example, from manufacturing. By way of example, an element illustrated or described as a rectangle may have rounded or curved features and/or a gradient concentration at its edges rather than a discrete change from one element to another. Thus, the elements illustrated in the drawings are schematic in nature and their shapes are not intended to illustrate the precise shape of an element and are not intended to limit the scope of the present invention.

It will be understood that when an element such as a region, layer, section, substrate, or the like, is referred to as being "on" another element, it can be directly on the other element or intervening elements may also be present. In contrast, when an element is referred to as being "directly on" another element, there are no intervening elements present. It will be further understood that when an element such as a structure is referred to as being coupled to another element, it can be directly connected to the other element or intervening elements may also be present. For example, one element may be electrically coupled to another by direct conductive connection, or there may be an intervening electrically conductive connector, a capacitive, inductive or other form of connection which provides for transmission of electrical current, power, signal or equivalents. Similarly, two elements may be mechanically coupled by being either directly physically connected, or intervening connecting elements may be present. It will be further understood that when an element is referred to as being "formed" on another element, it can be grown, deposited, etched, attached, connected, coupled, or otherwise prepared or fabricated on the other element or an intervening element.

Furthermore, relative terms, such as "lower" or "bottom" and "upper" or "top," may be used herein to describe one element's relationship to another element as illustrated in the drawings. It will be understood that relative terms are intended to encompass different orientations of an apparatus in addition to the orientation depicted in the drawings. By way of example, if an apparatus in the drawings is turned over, elements described as being on the "lower" side of other elements would then be oriented on the "upper" side of the other elements. The term "lower", can therefore, encompass both an orientation of "lower" and "upper," depending of the particular orientation of the apparatus. Similarly, if an apparatus in the drawing is turned over, elements described as "below" or "beneath" other elements would then be oriented "above" the other elements. The terms "below" or "beneath" can, therefore, encompass both an orientation of above and below.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and this disclosure.

As used herein, the singular forms "a," "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. The term "and/or" includes any and all combinations of one or more of the associated listed items.

The detailed description set forth below in connection with the appended drawings is intended as a description of various aspects of the present invention and is not intended to represent all aspects in which the present invention may be practiced. The detailed description includes specific details for the purpose of providing a thorough understanding of the present invention. However, it will be apparent to those skilled in the art that the present invention may be practiced without these specific details. In some instances, well-known structures and components are shown in block diagram form in order to avoid obscuring the concepts of the present invention.

Various aspects of a light source will now be presented. However, as those skilled in the art will readily appreciate, these aspects may be extended to other apparatus without departing from the spirit and scope of the invention. The light source may include a series of solid state light emitting devices mounted on a mounting carriage. The mounting carriage is configured to replace one or more parts of the illumination system in any of a plurality of available housing heads for lighting. The plurality of housing heads may differ in at least one dimension, and the illumination systems may also vary in illumination pattern and intensity requirements. The mounting carriage may have at least one dimension that is variable to enable installation in any of the plurality of housing heads.

Disclosed is an apparatus and method for retrofitting conventional lighting systems, such as, for example, street lights, with solid state light emitting devices assembled on a mounting carriage that enables installation where previously non-solid state light emitting devices were installed. The solid state light emitting devices (and/or arrays of them) require a mounting device to enable installing them, for example, in conventional street lamp domes, such as a cobra head.

An example of a solid state light emitting device for used in solid state light emitting devices is the light emitting diode (LED). The LED is well known in the art, and therefore, will only briefly be discussed to provide a complete description of the invention. An LED is a semiconductor material impregnated, or doped, with impurities. These impurities add "electrons" and "holes" to the semiconductor, which can move in the material relatively freely. Depending on the kind of impurity, a doped region of the semiconductor can have predominantly electrons or holes, and is referred to as n-type or a p-type semiconductor region, respectively. In LED applications, the semiconductor includes an n-type semiconductor region and a p-type semiconductor region. A reverse electric field is created at the junction between the two regions, which cause the electrons and holes to move away from the junction to form an active region. When a forward voltage sufficient to overcome the reverse electric field is applied across the p-n junction, electrons and holes are forced into the active region and combine. When electrons combine with holes, they fall to lower energy levels and release energy in the form of light.

LEDs are available in a range of colors of relatively narrow bandwidth. However, in applications where it is desirable to simulate illumination spectral properties representative of "white light" produced by incandescent, fluorescent, halogen or natural sunlight, one solution is to include one or more phosphors in a carrier encapsulating, or as a layer above, a blue LED. The phosphors absorb a portion of the short wavelength blue light and emit longer wavelengths of light by a process of Stokes shift emission. By controlling the type and amount of phosphor a balanced mix of light emitted by the LED directly and the phosphor is perceive by the human eye as "white light."

Referring to FIG. 1, the LED 101 includes a substrate 102, an epitaxial-layer structure 104 on the substrate 102, and a pair of electrodes 106 and 108 on the epitaxial-layer structure 104. The epitaxial-layer structure 104 comprises an active region 116 sandwiched between two oppositely doped epitaxial regions. In this example, an n-type semiconductor region 114 is formed on the substrate 102 and a p-type semiconductor region 118 is formed on the active region 116, however, the regions may be reversed. That is, the p-type semiconductor region 118 may be formed on the substrate 102 and the n-type semiconductor region 114 may formed on the active region 116. As those skilled in the art will readily appreciate, the various concepts described throughout this disclosure may be extended to any suitable epitaxial-layer structure. Additional layers (not shown) may also be included in the epitaxial-layer structure 104, including but not limited to buffer, nucleation, contact and current spreading layers as well as light extraction layers.

The electrodes 106 and 108 may be formed on the surface of the epitaxial-layer structure 104. The p-type semiconductor region 118 is exposed at the top surface, and therefore, the p-type electrode 106 may be readily formed thereon. However, the n-type semiconductor region 114 is buried beneath the p-type semiconductor region 118 and the active region 116. Accordingly, to form the n-type electrode 108 on the n-type semiconductor region 114, a portion of the active region 116 and the p-type semiconductor region 118 is removed to expose the n-type semiconductor region 114 therebeneath. After this portion of the epitaxial-layer structure 104 is removed, the n-type electrode 108 may be formed.

Figure 2:
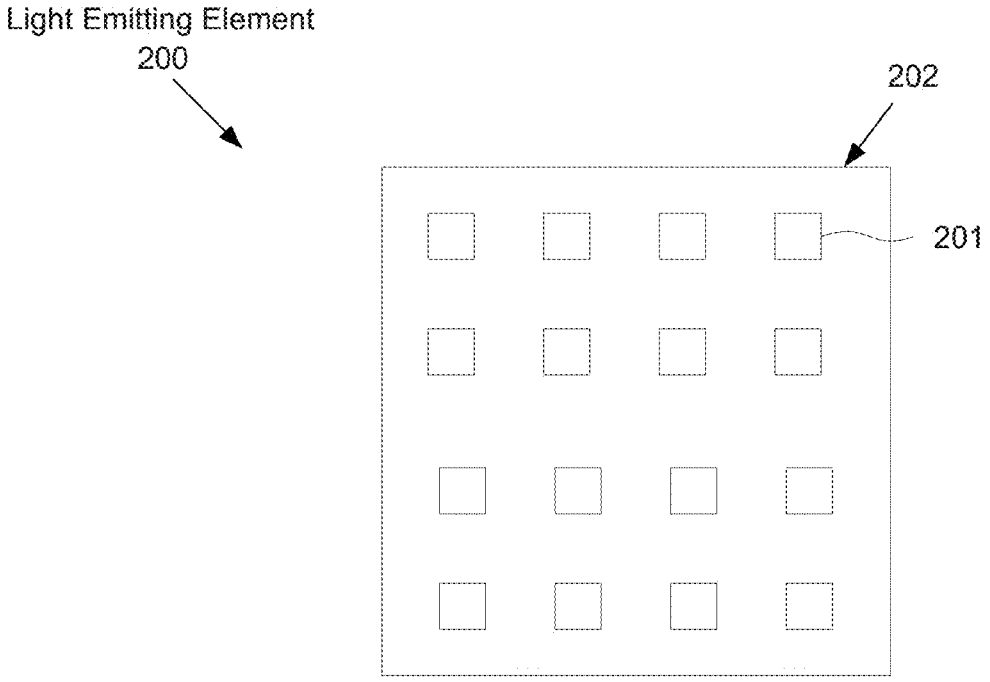
FIG. 2 is a conceptual cross-sectional view illustrating an example of an LED coated with a phosphor material.

As discussed above, one or more light emitting devices may be used to construct an LED array. One example of an LED array will now be presented with reference to FIG. 2. FIG. 2 is a conceptual top view illustrating an example of an LED array. In this example, an LED array 200 is configured with multiple LEDs 201 arranged on a substrate 202. The substrate 202 may be made from any suitable material that provides mechanical support to the LEDs 201. Preferably, the material is thermally conductive to dissipate heat away from the LEDs 201. The substrate 202 may include a dielectric layer (not shown) to provide electrical insulation between the LEDs 201. The LEDs 201 may be electrically coupled in parallel and/or series by a conductive circuit layer, wire bonding, or a combination of these or other methods on the dielectric layer.

The LED array may be configured to produce white light. White light may enable the LED array to act as a direct replacement for conventional light sources used today in incandescent, halogen, fluorescent, HID, and other suitable lamps. There are at least two common ways of producing white light. One way is to use individual LEDs that emit wavelengths (such as red, green, blue, amber, or other colors) and then mix all the colors to produce white light. The other way is to use a phosphor material or materials to convert monochromatic light emitted from a blue or ultraviolet (UV) LED to broad-spectrum white light. The present invention, however, may be practiced with other LED and phosphor combinations to produce different color lights.

Figure 3A:
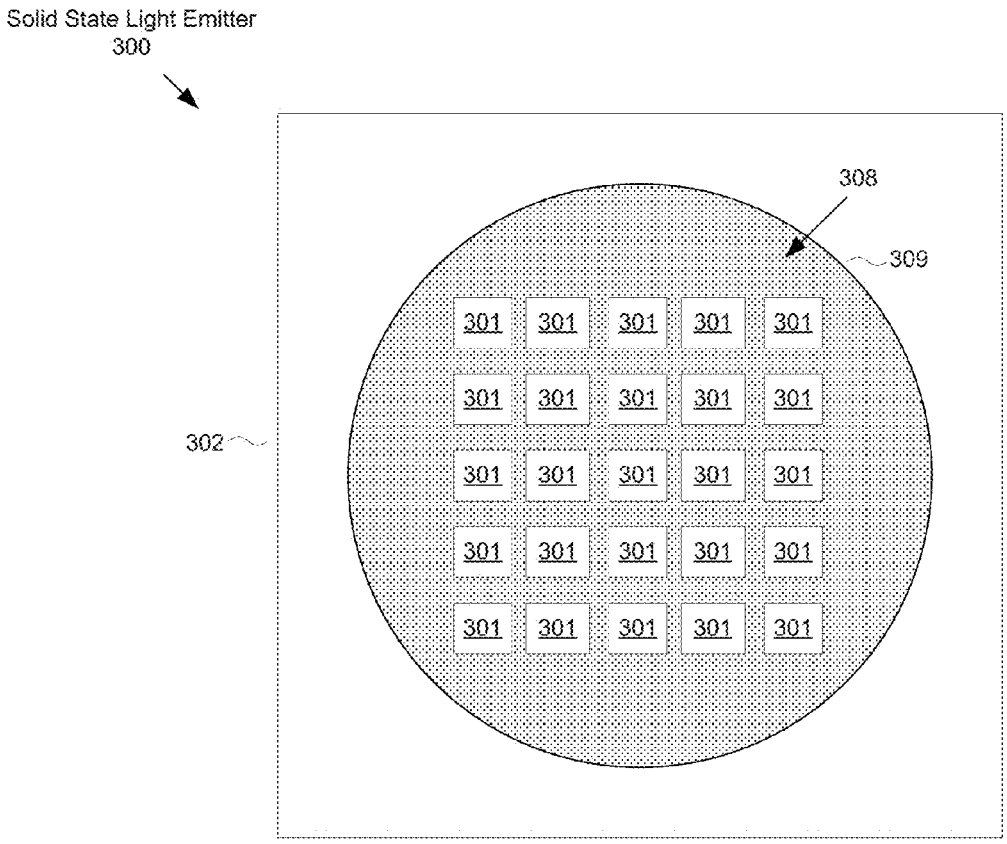
FIG. 3A is a conceptual top view illustrating an example of a white light source.
Figure 3B:
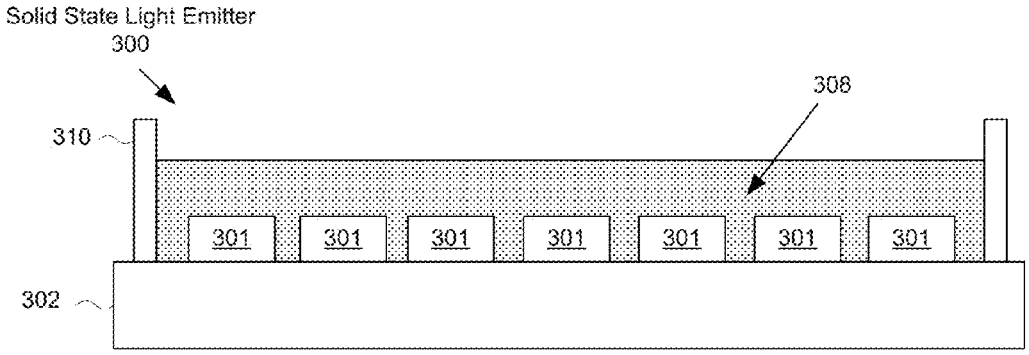
FIG. 3B is a conceptual cross-sectional side view of the white light source in FIG. 3A.

An example of a LED array will now be presented with reference to FIG. 3. FIG. 3A is a conceptual top view illustrating an example of a white light LED array, now referred to as a solid state light emitting device and FIG. 3B is a conceptual cross-sectional side view of the solid state light emitting device in FIG. 3A. The solid state light emitting device 300 is shown with a substrate 302 which may be used to support multiple LEDs 301. The substrate 302 may be configured in a manner similar to that described in connection with FIG. 2 or in some other suitable way. In this example, the substrate includes a plurality of slots 310 along the periphery. A phosphor material 308 may be deposited within a cavity defined by an annular, or other shaped, or other boundary 309 that extends circumferentially, or in any shape, around the upper surface of the substrate 302. The annular boundary 309 may be formed with a suitable mold, or alternatively, formed separately from the substrate 302 and attached to the substrate 302 using an adhesive or other suitable means. The phosphor material 308 may include, by way of example, phosphor particles suspended in an epoxy, silicone, or other carrier or may be constructed from a soluble phosphor that is dissolved in the carrier.

In an alternative configuration of a white light emitting element, each LED 301 may have its own phosphor layer. As those skilled in the art will readily appreciate, various configurations of LEDs and other light emitting devices may be used to create a white light emitting element. Moreover, as noted earlier, the present invention is not limited to solid state lighting devices that produce white light, but may be extended to solid state lighting devices that produce other light colors.

By way of example, street lighting systems will be used to describe the properties and use of a carriage for retrofitting lighting system. However, as those skilled in the art will readily appreciate, these aspects may be extended to other light sources without departing from the spirit and scope of the invention.

Figure 4:
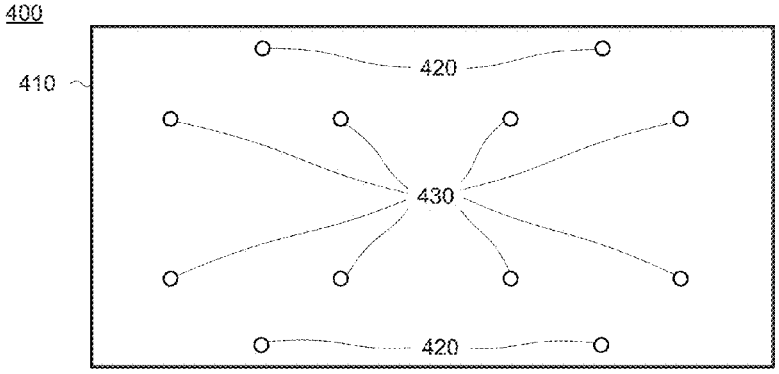
FIG. 4 illustrates an example of a mounting carriage.

FIG. 4 illustrates a mounting carriage 400 ("carriage") for supporting solid state light emitting devices 300. A carriage 400 may be adapted to attach to any of a plurality of conventional street lights in place of a non-solid state light source. Each of the plurality of conventional street light may differ from each other in at least one physical dimension.

The mounting carriage 400 may be mounted in a head of a street light. The carriage 400 may be attached to a lighting fixture in place of a conventional non-solid state lighting system using at least one hole formed in the mounting carriage 400. The mounting carriage 400 comprises a plate 410. The plate 410 comprises a plurality of holes 420 that admit a properly sized threaded screw or bolt and which are arranged to affix the plate 410 to threaded holes in the housing head, or by an equivalent means of attachment. In one embodiment, the bolt may be a spring bolt, which comprises an at least partially threaded bolt and a spring. Spring bolts are well known in the fastener arts. A heat spreader having one or more holes to pass at least the threaded portion of the spring bolts may placed between the plate 410 and the mounting holes of the head.

When the spring bolts, or other equivalent form of fastening is tightened, the spring bolts bias the shape of the heat spreader, forcing the heat spreader into direct contact with the head for thermal conductivity. For example, the mounting holes may be mounting holes used to hold a reflector in the head for a conventional non-solid state light source. The reflector is typically curved to match the inner shape of the head. Therefore, the force provided by the tightened spring bolts can bias to deform the heat spreader to conform substantially to a shape similar to the inner shape of the head. The heat spreader may comprise a thin aluminum plate that is flexibly deformable and having adequate thermal conductivity to spread the heat from the solid state light emitting devices 300 passing through the plate 410 and the thermal interface material.

The plate 410 further comprises a plurality of threaded holes 430 configured to secure one or more solid state light emitting devices 300 by attaching the substrate 302 to the plate, as described below.

The plate 410 may include attachment points, such as clips, threaded holes for screws or bolts, non-threaded holes for bolts, or the like, to attach the solid state light emitting devices 300 to the plate 410.

Figure 5B:
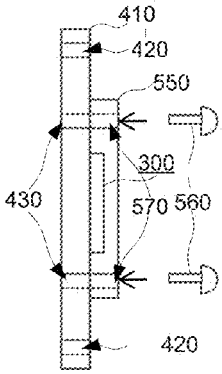
FIG. 5B illustrates a side view of the mounting carriage and a solid state light emitting devices of FIG. 5A.
Figure 5A:
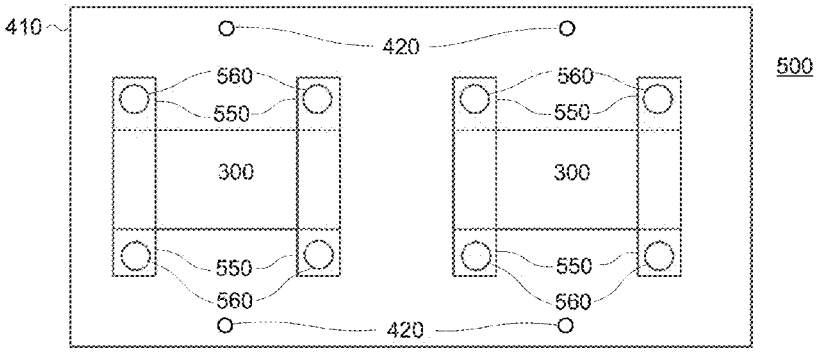
FIG. 5A illustrates a plan view of an example of a mounting carriage including one or more solid state light emitting devices attached.

FIG. 5 shows an example a carrier 400 adapted to attach solid state light emitting devices 300 to plate 410 using a flange (or bracket) 550 to hold the solid state light emitting devices 300 against the plate 410, although other equivalent means of attachment are equally valid. By way of example, threaded screws (or bolts) 560 pass through clearance holes 570 in the flange 550 to threaded holes 430 in the plate 410 to fasten the solid state light emitting devices 300 to the plate 410. Alternatively, holes 430 may be through holes 430 and a threaded nut may be used to fix screw 460 to couple the assembly of the solid state light emitting devices 300 and flange 550 to the plate 410.

Figure 6:
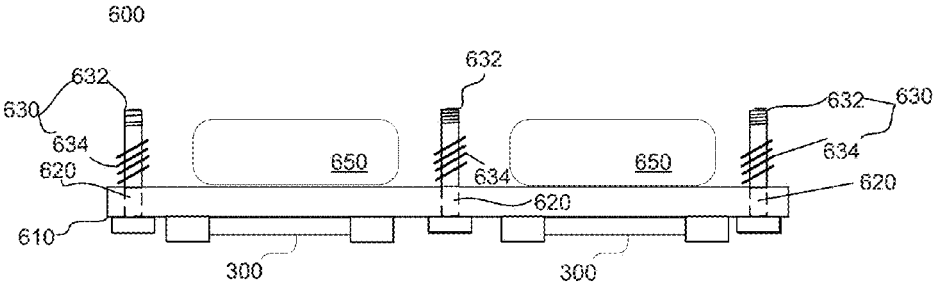
FIG. 6 illustrates a side view of an example of the mounting carriage of FIGS. 5A and 5B including a heat spreader for attaching with spring bolts to a light pole header.

FIG. 6 shows a mounting carriage 600 configured to be mounted in a head of a street light. The carriage 600 may be attached to a lighting fixture in place of a conventional non-solid state lighting system using at least one hole formed in the mounting carriage 600. The mounting carriage 600 comprises a plate 610 which serves as a heat spreader. The plate 610 comprises a plurality of holes 620 that admit a properly sized threaded screw or bolt and which are arranged to affix the plate 610 to threaded holes in the housing head, or by an equivalent means of attachment. In one embodiment, the bolt may be a spring bolt 630, which comprises an at least partially threaded bolt 632 and a spring 634. Spring bolts 630 are well known in the fastener arts.

A thermal interface material 650 may be used between the heat spreader and the head to provide a better thermal connection. A similar thermal contact material may be used between the heat spreader and the plate 410 for the same purpose. The thermal interface material may be thermal grease, thermal epoxy, or flexible material, such as manufactured by GrafTech™, or some other suitable material. Preferably, the thermal interface material is flexibly compressible and deformable.

When the spring bolts 630, or other equivalent form of fastening is tightened, the spring bolts 630 bias the plate 610 toward the head. For example, the mounting holes may be the same mounting holes used to hold a reflector in the head for a conventional non-solid state light source. The reflector is typically curved to match the inner shape of the head. Therefore, the plate 620 may be pre-shaped to conform to a shape substantially like the reflector so that force provided by the tightened spring bolts 630 can bias the combination of the plate 610 and the thermal interface material 650 to a shape similar to the inner surface of the head, with good thermal contact.

The mounting carriage 600 may be adjustable in at least one dimension such that the one or more holes 620 in the plate 610 can be aligned with one or more reflector mounting points in any of the plurality of lighting fixture.

Figure 7:
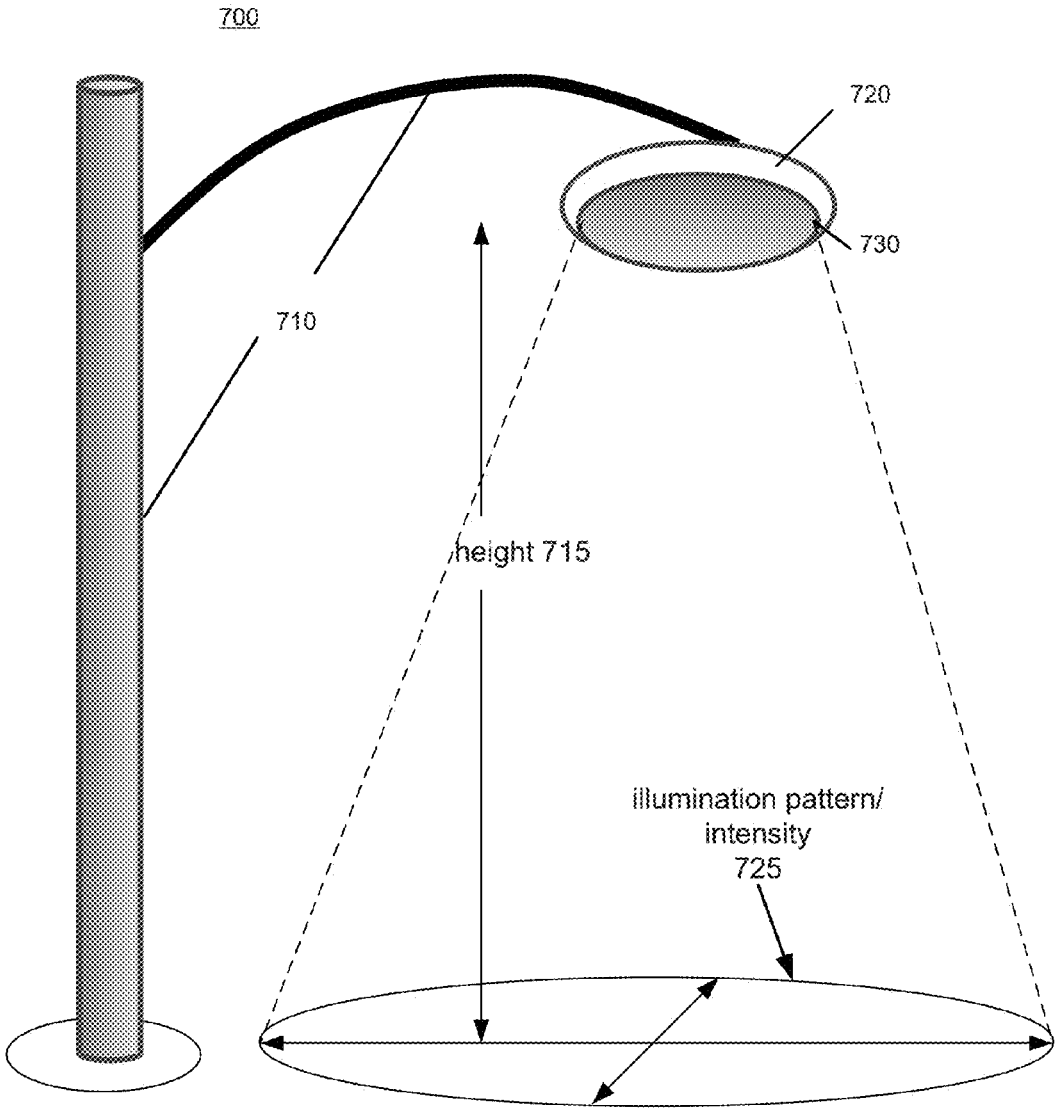
FIG. 7 illustrates a street light.

FIG. 7 is an example of an application of solid state light emitting devices 300 to a street lamp 700. The street lamp 700 includes a lamp pole 710 and the overhanging arm, 714 (note, add 714 to drawing pointing to the arm), and a head 720 attached to the pole 710. The head 720 includes a light source comprising a plurality of solid state light emitting devices 300 (not shown in FIG. 8) and an optical element 730 configured to produce a light distribution pattern from the light emitted from the solid state light emitting devices.

An example of the components included in the head 720 is described with reference to FIGS. 4-6, above, and will not be related in detail here.

The optical element 730 may comprise a single dome opposite the solid state light emitting devices 300 arranged to produce a light distribution pattern 725, as may be needed for any particular street illumination requirement. The dome may include any of a plurality of sub-elements mounted separately to direct and/or diffuse the light from the solid state emitting devices. Alternatively, the solid state light emitting devices may have the optical element 730 comprised of a single molded optical structure or a plurality of sub-structures molded to the surface of the solid state light emitting devices 300.

A street light having a conventional first light source may be retrofitted by removing the first light source from the head 720 and installing a second light source comprising a plurality of solid state light emitting devices 300. The solid state light emitting devices 300 may be mounted on a substrate 302, as described above, and with or without a heat sink, as described above. The substrate 302 may be supported by the plate 610 of the mounting carriage 600, as described above. The mounting carriage 600 may further include the heat spreader 640, affixed to the plate 610 and attached to the head 720 as described above.

Removing the first light source may include removing a non-solid state light source and a reflector from the head 720. The reflector may be removed, for example, by removing the one or more screws extending through the reflector into the one or more screw holes in the head 720 and attaching the second light source.

The second light source may be installed by inserting one or more screws through the plate 410 of the mounting carriage 400 into the one or more screw holes in the head 720. Electrical connection and voltage transformation can be made via a plurality of wires and an electrical driver interface as required to couple to one or more electrical lines from the pole 710.

Among the characteristics that are taken into account to select an array size of solid state light emitting devices 300 and the focusing, dispersion and/or diffusion properties of the optical element 730, are included the height 715 of the lamp post 710, and the illumination pattern/intensity 725 sought for the application.

The claims are not intended to be limited to the various aspects of this disclosure, but are to be accorded the full scope consistent with the language of the claims. All structural and functional equivalents to the elements of the various aspects described throughout this disclosure that are known or later come to be known to those of ordinary skill in the art are expressly incorporated herein by reference and are intended to be encompassed by the claims. Moreover, nothing disclosed herein is intended to be dedicated to the public regardless of whether such disclosure is explicitly recited in the claims. No claim element is to be construed under the provisions of 35 U.S.C. §112, sixth paragraph, unless the element is expressly recited using the phrase "means for" or, in the case of a method claim, the element is recited using the phrase "step for."

What is claimed is:

1. A method for retrofitting a street light, the method comprising:

providing a street light head configured for housing a reflector and non solid state light emitting device;

receiving, in the street light head, a mounting carriage as a replacement for the reflector and non solid state light emitting device, the mounting carriage thermally coupled to a heat spreader and configured to accept one or more solid state light emitting devices; and providing spring bolts for mounting the heat spreader to the street light head, wherein the spring bolts bias to deform the heat spreader to conform substantially to an inner shape of the street light head.

2. The method of claim 1, wherein the mounting carriage comprises at least one hole aligned with at least one reflector mounting point in the street light head.

3. The method of claim 2, further comprising inserting at least one of the spring bolts into the at least one hole aligned with the at least one reflector mounting point in the street light head to install the mounting carriage in the street light head.

4. The method of claim 1, wherein the mounting carriage comprises two sets of holes, and wherein:

the heat spreader is mounted to the street light head using the first set holes, such that the heat spreader is thermally coupled to the street light head, and the one or more solid state light emitting devices is mounted to the heat spreader using the second set of holes.

5. The method of claim 4, further comprising inserting the spring bolts in the first set of holes to mount the heat spreader to the street light head.

6. A method for retrofitting a street light, the method comprising:

removing, from a street light head, a reflector and non-solid state light emitting device;

installing, in the street light head, a mounting carriage to replace the reflector and the non-solid state light emitting device, the mounting carriage thermally coupled to a heat spreader and configured to accept one or more solid state light emitting devices; and inserting spring bolts for mounting the heat spreader to the street light head, wherein the spring bolts bias to deform the heat spreader to conform substantially to an inner shape of the street light head.

7. The method of claim 6, wherein the mounting carriage comprises two sets of holes, and wherein:

the heat spreader is mounted to the street light head using the first set holes, such that the heat spreader is thermally coupled to the street light head, and the one or more solid state light emitting devices is mounted to the heat spreader using the second set of holes.

8. The method of claim 7, further comprising inserting the spring bolts in the first set of holes to mount the heat spreader to the street light head.

* * * * *